US012663246B2

(12) United States Patent
Bucher

(10) Patent No.: US 12,663,246 B2
(45) Date of Patent: Jun. 23, 2026

(54) IGNITION DEVICE FOR AMMUNITION, IN PARTICULAR MEDIUM-CALIBER AMMUNITION, AND ASSOCIATED METHOD FOR IGNITION OR FOR SELF-DESTRUCTION OF AMMUNITION, IN PARTICULAR MEDIUM-CALIBER AMMUNITION

(71) Applicant: RWM SCHWEIZ AG, Zürich (CH)

(72) Inventor: Ruedi Bucher, Oberrohrdorf (CH)

(73) Assignee: RWM SCHWEIZ AG, Zürich (CH)

( * ) Notice: Subject to any disclaimer, the term of this patent is extended or adjusted under 35 U.S.C. 154(b) by 0 days.

(21) Appl. No.: 18/690,118

(22) PCT Filed: Sep. 8, 2022

(86) PCT No.: PCT/EP2022/075012
§ 371 (c)(1),
(2) Date: Mar. 7, 2024

(87) PCT Pub. No.: WO2023/036879
PCT Pub. Date: Mar. 16, 2023

(65) Prior Publication Data

US 2024/0377175 A1 Nov. 14, 2024

(30) Foreign Application Priority Data

Sep. 9, 2021 (DE) ..... 10 2021 123 375.5

(51) Int. Cl.
*F42C 15/40* (2006.01)
*F42C 11/00* (2006.01)

(52) U.S. Cl.
CPC ..... *F42C 11/008* (2013.01)

(58) Field of Classification Search
CPC ... F42D 1/055; F42D 1/05; F42D 3/00; F42D 3/04; F41A 17/08; F41A 19/65;
(Continued)

(56) References Cited

U.S. PATENT DOCUMENTS 3,750,584 A * 8/1973 Voyentzie ..... F42C 15/40 429/114
5,387,257 A * 2/1995 Tari ..... F42C 9/16 102/226

(Continued)

*Primary Examiner* — Michael D David
(74) *Attorney, Agent, or Firm* — Maschoff Brennan

(57) ABSTRACT

The invention relates to an ignition device for ammunition, in particular medium-caliber ammunition, comprising at least one battery and at least one electric or electronic ignition-chain component, wherein: the battery has a battery housing; an electrolyte and at least two electrodes are located in the battery housing; an explosive charge of the ammunition can be caused to explode by means of the electric or electronic ignition-chain component, and the energy required to trigger the electric or electronic ignition-chain component can be provided by means of the battery. The ignition device provides for a sufficient amount of energy, and the volume in the ignition device is at the same time utilized particularly efficiently in that the battery housing has a cup-shaped recess, and at least part of the at least one electric or electronic ignition-chain component is located in the cup-shaped recess.

14 Claims, 2 Drawing Sheets

Figure 1:
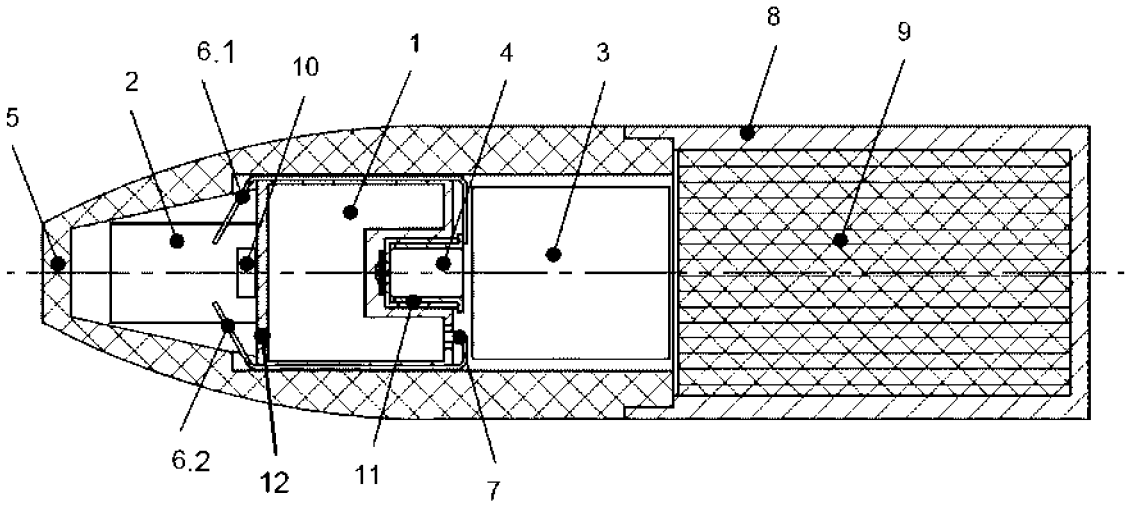

(58) Field of Classification Search
CPC .. F41G 3/04; F42C 15/40; F42C 15/42; F42C 15/44; F42C 11/008; H01M 6/36
USPC ..... 102/200, 301, 311, 221, 313, 322, 401, 102/403, 426; 89/1.11
See application file for complete search history.

(56) References Cited

U.S. PATENT DOCUMENTS

| | | | | |
|---|---|---|---|---|
| 10,186,713 | B2 * | 1/2019 | Rastegar | H02N 2/181 |
| 2018/0013152 | A1 * | 1/2018 | Rastegar | H02N 2/181 |
| 2020/0166321 | A1 * | 5/2020 | Zemla | F42B 3/122 |
| 2022/0082364 | A1 * | 3/2022 | Zemla | F42B 3/122 |
| 2023/0304782 | A1 * | 9/2023 | Zemla | F42B 3/122 |

* cited by examiner

IGNITION DEVICE FOR AMMUNITION, IN PARTICULAR MEDIUM-CALIBER AMMUNITION, AND ASSOCIATED METHOD FOR IGNITION OR FOR SELF-DESTRUCTION OF AMMUNITION, IN PARTICULAR MEDIUM-CALIBER AMMUNITION

The invention relates to an ignition device for ammunition, in particular for medium-caliber ammunition with the features of the generic term of claim 1. The invention also relates to a method for igniting or self-destruction of ammunition, in particular medium-caliber ammunition, comprising the ignition device according to the invention with the features of the generic term of claim 14.

Ignition devices, also known as detonators, are used to initiate an active charge of various explosive devices such as explosives, bombs, rockets, mines, grenades or cartridge ammunition. In the particular case of ammunition, there are a large number of different types of detonators that are used in different areas of application. One type of detonator is the proximity detonator, which initiates the explosive charge when the target is approached and is known, for example, from EP0129679 and U.S. Pat. No. 3,839,963.

Modern proximity fuses comprise a large number of components such as antennas, radio equipment, radar transmitters and receivers, proximity sensors as well as detonators and detonator fuses that need to be supplied with electric power.

The more numerous and powerful these components are, the greater the demands on the energy storage system used. As a rule, powerful batteries are therefore used to meet the energy requirements. A particular problem, however, is the space required by these batteries, which can take up a considerable proportion of the volume of the proximity fuse, especially with medium and small-caliber ammunition, thus limiting the space available for other functionally relevant components.

Previously known solutions utilise the principle of a so-called set-back generator, as known from U.S. Pat. No. 3,981,245, for example. These generators take up relatively little space, but can only provide a limited amount of energy. This type of power supply is inadequate for complex electric/electronic ignition components.

U.S. Pat. No. 5,147,974 describes a detonator for medium-caliber ammunition in which the total energy requirement of the components is reduced by using a mechanical detonator protection. The problem with this approach is that, due to production tolerances, mechanical fuses have a greater tendency to malfunction, e.g. in the sense of a blind shell or unintentional ignition directly on firing.

A proximity fuse for rockets is known from GB1584305, in which the total energy requirement of the components is reduced by using a magnetic proximity sensor. However, due to the operating principle of the sensor, this type of application can only be used to detect the approach of a ferromagnetic target. In addition, it can be assumed that magnetic interference can have a negative effect on the performance of the proximity sensor.

DE10341713 describes a fuse for spin-stabilised artillery projectiles in which part of the energy requirement is taken from the spin of the projectile by a generator, thus enabling the energy storage to be made smaller. In addition to the increased complexity of the fuse design, the required speed of 300 to 350/s, which restricts the range of applications to specific types of ammunition, also appears to be a problem with this approach.

A further problem of the cited prior art is the sequential arrangement of the components, which makes the length of the sensors and/or the detonator dependent on the length of the battery.

A well-known battery for fuses is the UA 6215 Army Artillery Fuze Battery, manufactured by Thales Cryogenics, in which 6 to 9 cells are arranged around a glass ampoule with an electrolyte. When firing ammunition using a battery of this type, the glass ampoule breaks and the electrolyte it contains activates the surrounding cells. A disadvantage of this known battery shape is the inadequate utilisation of the housing volume, as large areas between the glass ampoule and the battery base are kept free for the distribution of the electrolyte.

As a further development of this battery shape, it was proposed to replace the ring-shaped cell stacks with a single ring-shaped cell of higher capacity. A disadvantage of this further development is the inadequate utilisation of the available space on the side of the glass ampoule.

The invention is therefore based on the task of providing an ignition device for ammunition, in particular for medium-caliber ammunition, whereby a sufficient amount of energy can be provided by means of the ignition device and at the same time the available volume in the ignition device can be utilised particularly efficiently. Furthermore, a method for igniting or self-destruction of ammunition, in particular medium-caliber ammunition, comprising the ignition device is to be improved.

This problem underlying the invention is now solved first of all by a firing device for ammunition, in particular for medium-caliber ammunition, with the features of claim 1.

The basic principle of the invention essentially lies in the fact that the battery housing has a cup-shaped recess, with at least one electric or electronic ignition chain component being arranged at least partially in the cup-shaped recess.

In this way, the battery and at least one electric or electronic ignition chain component require only a small amount of space within the ammunition. In particular, the battery and at least one electric or electronic ignition chain component can be arranged in a particularly short axial section of the ammunition.

In a preferred embodiment, the ignition device has an electric detonator. The electric detonator is the first detonation chain component designed to initiate the explosion of the active charge of the ammunition. In particular, this electric detonator is arranged at least partially in the cup-shaped recess.

The electric detonator is also known as an EED (Electro Explosive Device). This generally refers to a transformer for one-off applications that converts electric energy into either heat and/or mechanical work. Depending on the quantity of explosives contained in the detonator, the active charge can be detonated directly or via an intermediate amplifier stage. Such an amplifier stage is then also part of a so-called ignition chain as a second ignition chain component. If several ignition chain components are present, they are arranged one after the other to form the ignition chain.

In a further embodiment of the ignition device, the ignition device has an electronic unit. The electronic unit has a proximity sensor with sensor electronics and/or a height detector and/or an antenna.

Such components enable various controls and functions of the firing device and the superordinate ammunition.

Advantageously, the electronic unit has a printed circuit board. A printed circuit board is also known as a printed circuit board. The proximity sensor with the sensor electronics and/or the height detector and/or the antenna is/are arranged on the printed circuit board.

For example, the printed circuit board has areas for conducting current and the proximity sensor with the sensor electronics and/or the height detector and/or the antenna is/are connected to the printed circuit board using soldered joints and/or press contacts and/or plug contacts and/or adhesive connections and/or welded joints.

The electronic unit preferably has an ignition capacitor. The ignition capacitor is located on the printed circuit board. The ignition capacitor can be charged by means of the battery and the electric detonator can be detonated by means of the current provided by the ignition capacitor.

The ignition capacitor is able to provide the energy required to detonate the electric detonator very quickly. This means that the timing of the ignition of the active charge can be controlled very precisely using the ignition device.

In a further embodiment of the ignition device, the battery housing has at least one cable guide for accommodating an electric cable. The cable guide is designed as a groove in the battery housing, for example. Such a groove is advantageously aligned in a longitudinal direction of the ammunition. The cable guide minimises the risk of damage to the electric cable, e.g. when installing the ignition device.

At least one contact element is advantageously connected to the battery housing and/or the cells, so that energy can be transferred via the at least one contact element, in particular between the electric detonator and the electronic unit. Energy can also be transferred via at least one contact element between the battery housing and/or the cells and the electronic unit.

In addition to holding the electrolyte and at least two electrodes, the battery housing can also be used to conduct current. In this way, only very few additional electric cables are required to establish the desired connections. Various versions of the contact elements are conceivable.

The electronic unit is advantageously arranged on a side of the battery facing away from the electric detonator, in particular on the front side of the battery.

In a further embodiment of the ignition device, the electric detonator faces a detonator and/or the active charge of the ammunition, wherein the detonator and/or the active charge can be detonated by means of the electric detonator. Such a detonator is a special form of an amplifier stage.

The ignition device is preferably furnished with a fuse housing. The fuse housing is located at the tip of the ammunition. The battery, the electronic unit and the electric detonator can be mounted together as a single unit in the fuse housing.

In the assembled state, the electronic unit, then the battery and then the electric detonator are arranged sequentially from a tip to an end of the ignition device. This is particularly advantageous if a proximity sensor is part of the electronic unit, as the proximity sensor is then arranged close to the tip of the ignition device and therefore also close to the tip of the ammunition, enabling a particularly accurate distance measurement to a target by means of the proximity sensor.

In an alternative embodiment, the fuse housing is located at the base of the ammunition. The battery and the electric detonator can be mounted together as a single unit in the detonator housing. The electronic unit can then be arranged separately in the tip and/or in the sides of the ammunition and connected to the battery and the electric detonator in the base by an electric conductor. This makes it possible, for example, to use the ignition device according to the invention with shaped charge ammunition fired from the ground.

In the assembled state, first the battery and then the electric detonator and then the electronic unit are arranged sequentially from the floor to one end of the ignition device.

In a further embodiment of the ignition device, the battery has one or more cells.

The electrolyte is advantageously arranged inside an ampoule. The ampoule is designed to burst when the ammunition is fired, thus activating the battery. The battery is activated by the electrolyte flowing around the electrodes and the resulting contact between the electrodes and the electrolyte. The ampoule preferably has glass and/or a metallic material.

The task underlying the invention is also solved by a method for igniting or self-destruction of ammunition, in particular a medium-caliber ammunition, comprising the ignition device with the features of claim 14.

The basic principle of the invention then essentially lies in the fact that the battery housing has a cup-shaped recess, with at least one electronic ignition chain component being arranged at least partially in the cup-shaped recess.

In an advantageous embodiment of the method, the method comprises the following sequential steps:

a) Firing of the ammunition, in particular by electrical and/or mechanical initiation of a propellant;
b) Activation of the battery by the launch load;
c) Initialisation of the proximity sensor;
d) Charging the ignition capacitor using the battery;
e) Decouple the battery from the ignition capacitor;
f) Activate the sensor electronics and the height detector;
g) when a target is detected: Discharge of the ignition capacitor onto the electric detonator to initiate the explosion of the active charge;
h) alternatively to step g) if no target is detected: Self-destruction by discharging the ignition capacitor onto the electric detonator to initiate the explosion of the active charge.

Step b) also includes in particular the bursting of the ampoule. Decoupling the battery from the ignition capacitor in step e) ensures that, in the event of a blind shell, the battery is no longer coupled in as a power supply.

The ignition device is particularly advantageous for use in 35 mm caliber ammunition and in smaller caliber ammunition with proximity fuses. However, use is not limited to these types of ammunition.

The application of the ignition device and the associated method is also advantageous in other explosive devices such as rockets, artillery shells, bombs and anti-vehicle mines. Instead of proximity detonators, other types of detonators such as impact detonators or remotely activated detonators could also be used.

Figure 2:
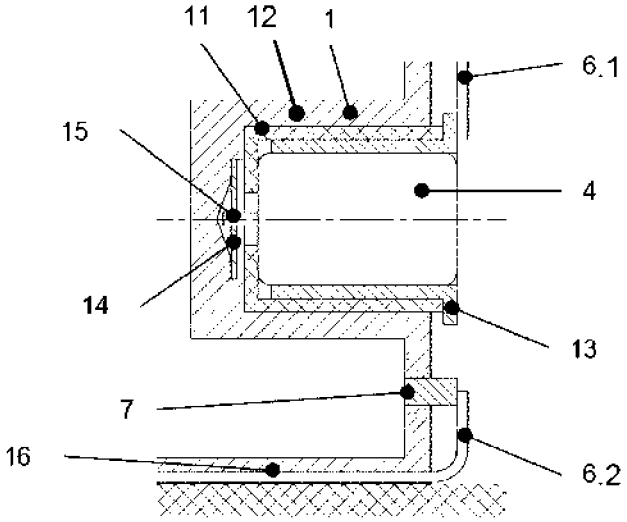
Figure 3:
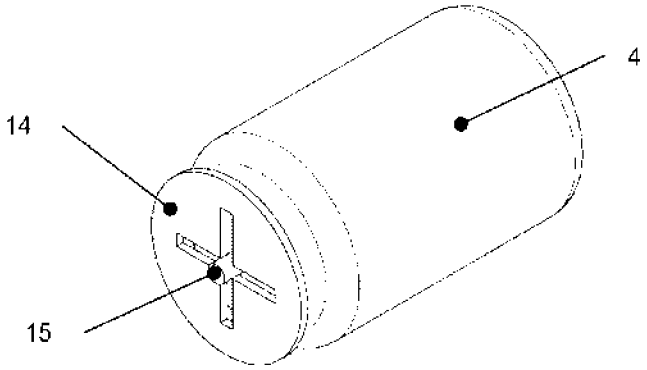

There are now a large number of possibilities for advantageously designing and further developing the ignition device according to the invention for ammunition, in particular a medium-caliber ammunition, and the associated method. Reference may first be made to the Claims following claim 1 and claim 14. In the following, a preferred embodiment of the ignition device according to the invention for ammunition, in particular medium-caliber ammunition, and the associated method are explained and described in more detail with reference to the drawing and the associated description. The drawing shows:

FIG. 1 schematic representation of an example of the firing device in a projectile of ammunition in a side view in section, FIG. 2 schematic representation of a detail of the embodiment of the ignition device in a side view in section, and FIG. 3 schematic representation of an electric detonator of the ignition device in a three-dimensional view.

FIG. 1 shows a schematic sectional view of a side view of an embodiment of the ignition device in a projectile of ammunition. FIG. 1 shows in particular the structure of an explosive grenade with a so-called head detonator. A battery 1, an electronic unit 2 and an amplifier stage 3 are arranged in the ignition device. Amplifier stage 3 can be designed in particular as a so-called "safe & arm unit". The battery 1 is located between the electronic part 2 and the amplifier stage 3 or Safe & Arm unit. The battery 1 is embedded in a detonator housing 5. The fuse housing 5 is in turn connected to a projectile or grenade body 8, whereby the projectile or grenade body 8 contains an active charge 9. The active charge 9 is also known as an explosive charge. The electronic unit 2 is attached directly to a battery housing 12 of battery 1. This can be achieved using at least one corresponding connecting element 10 such as a retaining clip, a soldering tab, a catch, a bracket, a clip, a plug-in contact or similar. Additionally or alternatively, this connecting element 10 can be soldered, welded or otherwise connected to the battery housing 12 and the electronic unit 2. The battery housing 12 contains the first element of the ignition chain, namely an electric detonator 4. This electric detonator 4 is embedded in the battery housing 12 by means of an insulating bushing 11, which is shown in more detail in FIG. 2. Like a conventional ammunition, the battery casing 12 has a cylindrical outer circumference. Furthermore, the battery housing 12 has a first end face, with the connecting element 10 being connected to the battery housing 12 at this first end face. The battery housing 12 has a second end opposite the first end, with a cup-shaped recess in the centre of this second end. The electric detonator 4 is arranged at least partially, preferably to a large extent, within the cup-shaped recess. The electric detonator 4 is thus partially enclosed by battery 1.

The insulating sleeve 11 has a contact 13, whereby the contact 13 is conductive and makes contact with a housing of the electric detonator 4. The contact 13 also provides a corresponding attachment point for a first electric cable 6.1. The first electric cable 6.1 is soldered, welded, crimped or plugged into the attachment point. The first electric cable 6.1 and a second electric cable 6.2 are also generally referred to in their entirety as cabling. In order to insulate the housing of the electric detonator 4 from the battery housing 12, an insulating bushing 11 made of electrically non-conductive material is required. The connection between the contact 13 and the insulation socket 11 as well as the battery housing 12 can be plugged, pressed, screwed, crimped or glued. The electric detonator 4 or a pin 15 of the electric detonator 4 makes contact with the battery housing 12 via a plug-in contact 14, which is designed as a contact disc in FIG. 2. During assembly, the pin 15 of the electric detonator 4 is inserted into the plug contact 14, which is designed as a contact disc. A battery pin 7 is contacted via the second electric cable 6.2, whereby this second electric cable 6.2 can be routed directly in a cable guide 16 on the circumference of the battery housing 12. The entire design of the ignition device serves to reduce the overall length and to minimise the space required for contacting the electric detonator 4.

FIG. 3 shows the structure of the plug contact 14 in more detail. It can also be seen how the contacting of the pin 15 of the electric detonator 4 is achieved.

The battery housing 12 has lateral cable guides 16, whereby the cable guides 16 are designed as grooves in the battery housing 12. The grooves are aligned in a longitudinal direction of the ammunition.

The first electric cable 6.1 for connecting the contact 13 to the electronic unit 2 and the second electric cable 6.2 for connecting the battery pin 7 to the electronic unit 2 are arranged in the lateral cable guides 16. This ensures an electric connection from one end of battery 1 to the other.

The advantage of this design is that the assembly can be pre-assembled outside the detonator housing 5 and all the elements it contains are positioned and aligned. The assembly can then be inserted as a whole into the fuse housing 5.

The ignition device can be used to implement a process comprising the following sequential steps:

a) Firing of the ammunition, in particular by electrical and/or mechanical initiation of a propellant;
b) Activation of battery 1 by the launch load;
c) Initialisation of a proximity sensor;
d) Charging an ignition capacitor using battery 1;
e) Decouple the battery from the ignition capacitor;
f) Activation of sensor electronics and a height detector;
g) when a target is detected: Discharge of the ignition capacitor onto the electric detonator 4 to initiate the explosion of the active charge 9;
h) alternatively to step g) if no target is detected: Self-destruction by discharging the ignition capacitor onto the electric detonator 4 to initiate the explosion of the active charge 9.

Charging of the ignition capacitor by means of the battery 1 in step d) is made possible by the fact that the ignition capacitor and an electrolyte of the battery 1 and at least two electrodes of the battery 1 are part of a first circuit, or that a first circuit can be formed by a circuit of corresponding switches/components by means of the ignition capacitor and the electrolyte of the battery 1 and the at least two electrodes of the battery 1. The first circuit comprises, in particular in the following order, the electrolyte of the battery 1 and the at least two electrodes of the battery 1, the battery pin 7, the second electric cable 6.2, parts of the electronic unit 2, the ignition capacitor and other parts of the electronic unit 2, the ignition capacitor being one of these parts of the electronic unit 2.

The discharge of the ignition capacitor to the electric detonator 4 from step g) or h) is made possible by means of a second circuit, whereby this second circuit is closed for this discharge, in particular by means of corresponding switches/components. The second circuit comprises, in particular in the following order, the ignition capacitor, parts of the electronic unit 2, the first electric cable 6.1, the contact 13, the electric detonator 4, the pin 15, the plug contact 14, the battery housing 12, and other parts of the electronic unit 2.

The battery pin 7, the contact 13, the plug contact 14 and the pin 15 are generally also referred to as the contact element.

LIST OF REFERENCE SYMBOLS

1 Battery
2 Electronic unit
3 Amplifier stage
4 Electric detonator
5 Fuse housing
6.1 First electric cable
6.2 Second electric cable
7 Battery pin

8 Projectile or shell body
9 Active charge
10 Connecting element
11 Insulation socket
12 Battery housing
13 Contact
14 Plug contact
15 Pin
16 Cable routing

The invention claimed is:

1. Ignition device for ammunition, in particular medium-caliber ammunition, with at least one battery and with at least one electronic or electric ignition chain component, wherein the battery has a battery housing, wherein an electrolyte and at least two electrodes are arranged in the battery housing, wherein by means of the electronic ignition chain component an active charge of the ammunition can be made to explode, wherein the energy required for triggering the electronic or electric ignition chain component can be provided by means of the battery, wherein the battery housing has a cup-shaped recess, wherein the at least one electronic or electric ignition chain component is arranged at least partially in the cup-shaped recess, wherein the ignition device has an electric detonator, wherein the electric detonator is designed as a first ignition chain component to initiate the explosion of the active charge of the ammunition, in particular wherein the electric detonator is arranged at least partially in the cup-shaped recess.

2. Ignition device according to claim 1, wherein the ignition device has an electronic unit, wherein the electronic unit has a proximity sensor with sensor electronics and/or a height detector and/or an antenna.

3. Ignition device according to claim 2, wherein the electronic unit has a printed circuit board, wherein the proximity sensor with the sensor electronics and/or the height detector and/or the antenna is/are arranged on the printed circuit board.

4. Ignition device according to claim 2, wherein the electronic unit has an ignition capacitor, wherein the ignition capacitor is arranged on the printed circuit board, wherein the ignition capacitor can be charged by means of the battery, wherein the electric detonator can be detonated by means of current provided by the ignition capacitor.

5. Ignition device according to claim 1, wherein the battery housing has at least one cable guide for accommodating an electric cable.

6. Ignition device according to claim 1, wherein at least one contact element is connected to the battery housing, so that energy transmission is made possible via the at least one contact element and the battery housing, in particular between the electric detonator and the electronic unit.

7. Ignition device according to claim 2, wherein the electronic unit is arranged on a side of the battery facing away from the electric detonator.

8. Ignition device according to claim 1, wherein the electric detonator faces a detonator and/or the active charge of the ammunition, wherein the detonator and/or the active charge can be detonated by means of the electric detonator.

9. Ignition device according to claim 2, wherein the ignition device has a fuse housing, wherein the fuse housing is arranged at a tip of the ammunition, wherein the battery, the electronic unit and the electric detonator can be mounted together as one unit in the fuse housing.

10. Ignition device according to claim 1, wherein the battery comprises one or more cells.

11. Ignition device according to claim 1, wherein the electrolyte is arranged inside an ampoule, the ampoule being designed to burst when the ammunition is fired and that the battery is then activated.

12. Ignition device according to claim 1, wherein the ampoule comprises glass and/or a metallic material.

13. Method for igniting or for self-destruction ammunition, in particular medium-caliber ammunition, comprising the ignition device according to claim 1, with at least one battery and with at least one electric or electronic ignition chain component, wherein the battery has a battery housing, wherein an electrolyte and at least two electrodes are arranged in the battery housing, wherein an active charge of the ammunition is caused to explode by means of the electric or electronic ignition chain component, wherein the energy required for triggering the electric or electronic ignition chain component is provided by means of the battery, wherein the battery housing has a cup-shaped recess, the at least one electric or electronic ignition chain component being arranged at least partially in the cup-shaped recess.

14. The method according to claim 13, wherein the method comprises the following sequential steps:

a) Firing of the military ammunition, in particular by electrical and/or mechanical initiation of a propellant;
b) Activation of the battery by the launch load;
c) Initialisation of the proximity sensor;
d) Charge the ignition capacitor using the battery;
e) Decouple the battery from the ignition capacitor;
f) Activate the sensor electronics and the height detector;
g) when a target is detected: Discharge of the ignition capacitor onto the electric detonator to initiate the explosion of the active charge;
h) alternatively to step g) if no target is detected: Self-destruction by discharging the ignition capacitor onto the electric detonator to initiate the explosion of the active charge.

* * * * *